US005846028A

United States Patent [19]

Thory

[11] Patent Number: 5,846,028

[45] Date of Patent: Dec. 8, 1998

[54] CONTROLLED PRESSURE MULTI-CYLINDER RISER TENSIONER AND METHOD

[75] Inventor: Gregory Thory, Houston, Tex.

[73] Assignee: HydraLift, Inc., Houston, Tex.

[21] Appl. No.: 904,672

[22] Filed: Aug. 1, 1997

[51] Int. Cl.[6] ..... B63B 35/44; B02B 17/00

[52] U.S. Cl. ..... 405/195.1; 166/350; 166/359; 405/224; 114/264

[58] Field of Search ..... 405/195.1, 224, 405/224.1–224.4, 223.1–227; 166/359, 350, 367, 355; 114/264, 265

[56] References Cited

U.S. PATENT DOCUMENTS

| | | | |
|---|---|---|---|
| 3,601,187 | 8/1971 | Tidwell | 166/359 X |
| 3,760,875 | 9/1973 | Busking | 166/359 X |
| 3,943,868 | 3/1976 | Person et al. | 114/264 |
| 4,059,148 | 11/1977 | Blomsma | 166/359 |
| 4,215,950 | 8/1980 | Stevenson | 405/195.1 |
| 4,222,341 | 9/1980 | Larsen et al. | 114/264 |
| 4,364,323 | 12/1982 | Stevenson | 405/195.1 X |
| 4,367,981 | 1/1983 | Shapiro | 405/195 |
| 4,379,657 | 4/1983 | Widiner et al. | 405/195 |
| 4,449,854 | 5/1984 | Nayler | 405/195.1 |
| 4,473,323 | 9/1984 | Gregory | 405/224 |
| 4,501,219 | 2/1985 | Bates | 114/264 |
| 4,537,533 | 8/1985 | Hampton | 405/227 |
| 4,576,516 | 3/1986 | Denison | 405/195.1 X |
| 4,576,517 | 3/1986 | McCann et al. | 405/195.1 |
| 4,626,136 | 12/1986 | Gunderson | 405/224 |
| 4,657,439 | 4/1987 | Petersen | 166/350 X |
| 4,770,563 | 9/1988 | Pido | 405/195.1 X |
| 4,808,035 | 2/1989 | Stanton et al. | 405/195 |
| 4,883,387 | 11/1989 | Myers et al. | 405/195 |
| 5,366,324 | 11/1994 | Arlt et al. | 405/195 |

*Primary Examiner*—Dennis L. Taylor
*Attorney, Agent, or Firm*—Derek R. Van Gilder

[57] ABSTRACT

A controlled-pressure multi-cylinder riser tensioner has a plurality of preferably six control-cylinder units (1) with proximal ends (2) attached pivotally to a bottom surface of an operational floor (3) and distal ends (5) attached pivotally to a riser-tensioner ring (6). Pressure lines (20, 38) in communication with opposite ends of the control cylinders lead to sources of pressure (46, 47, 48, 52, 53, 62, 63) that are separately controlled. Stroke length of the control-cylinder units is typically 50 feet. Projection of the control-cylinder units downwardly into a moon pool (9) avoids their obstruction of work space on an operational floor (3) of a vessel (4). Positioning pneumatic and hydraulic machinery (10) below deck with tubing leading to the control cylinders lowers center of gravity for marine stability. An over-capacity for tensioning the marine riser with a portion of the control cylinders inactive or incapacitated increases reliability. Pressure transducers (39) pressure-requirement criteria to a central control system (41, 42) for coordinated automatic or optionally manual control of fluid pressure for each control-cylinder unit separately. Fluid for pressurizing the control-cylinder units can be either liquid, gas which is preferably air or a combination of air and gas with liquid being pressured by compressed air in pressure converters 54. A use method is provided.

30 Claims, 11 Drawing Sheets

3
15
19
2
30
20
32
33
38
1
35
31
34
5
6
24
7

CONTROLLED PRESSURE MULTI-CYLINDER RISER TENSIONER AND METHOD

BACKGROUND OF THE INVENTION

1. Field of the Invention

This invention relates to tensioning of seabed-to-vessel marine risers with a plurality of long pneumatic or hydraulic cylinders having separately controllable tension for deep-sea and storm-condition use in addition to shallow-water and all-weather use with ease of operation and high reliability.

2. Relation to Prior Art

Increasingly, exploration and production of petroleum, including both oil and gas, is in deep oceans where it is believed professionally that over 95 percent of the total world amount of petroleum exists. Physical obstacles and related costs, however, are comparatively greater obstacles than for land- or offshore-based petroleum.

Major difficulties and costs for deep-water activities involve upward tensioning of seabed-to-vessel marine risers while working through them from operational floors of marine vessels. Tubing used for marine risers preferably has the thinnest walls and smallest diameter that can accommodate conveyance of exploration and production items through it for accomplishing particular sub-sea objectives. Risers would bend, buckle and fail in their functions if not tensioned vertically upward with a tensioner on a marine vessel and/or supported with buoyancy having a similarly tensioning effect. In the most evenly tensioned mode possible during all-directional movement of a vessel, a riser is projected up through a watertight opening referred to as a moon pool in the vessel to working equipment and connections proximate an operational floor on the vessel.

A variety of means are known for tensioning risers. The most common are cable-operated systems that have been developed for offshore activities but are too heavy, space-consuming, expensive and top-heavy for optimal deep-ocean petroleum vessels. Other known risers are basically resilience systems that employ various types of spring tension with erratically changeable tension and related problems resulting in high costs and limited deep-water capability. None are known to provide constancy of tension, long-length tensioning, effective positioning within a moon pool, low weight, economy, convenience, time-saving features, fire protectiveness and reliability with adjustably controlled tension in a manner taught by this invention. Deeper-ocean and stormier-weather operations are made economically feasible in addition to benefitting shallow offshore petroleum conditions similarly.

Examples of different but related riser tensioners without control of tension rate and length and without other advantages taught by this invention are described in the following patent documents. U.S. Pat. No. 5,366,324, issued to Arlt et al, described use of either elastomeric pads and/or helical metal springs as energy-absorbing means having radical differences in tension per length of riser travel in a moon pool. U.S. Pat. No. 4,883,387, issued to Myers et al, taught a plurality of at least three pneumatic-cylinder tensioners without evenly controlled tension length and tension level throughout length of riser travel. U.S. Pat. No. 4,808,035, issued to Stanton et al, taught an elastomeric bellows as a gas spring for riser tensioning on a tension-leg platform. U.S. Pat. No. 4,537,533, issued to Hampton, taught riser tensioning with a heave compensator on a hoisting apparatus that was used primarily for positioning seabed templates from a semi-submersible drill rig. U.S. Pat. No. 4,473,323, issued to Gregory, described a horizontally elongated arm that was pivotal vertically about a first end and adapted to be ballasted and "deballasted" for tensioning a riser to which it was connected from a drilling vessel. U.S. Pat. No. 4,379,657, issued to Widiner at al, was limited to a portable modular riser tensioner having at least two pairs of cylinders that are diametrically opposed with interconnected oil accumulators and air accumulators with positioning between a mounting frame and a riser tensioning ring for use on a tensioned-leg platform. U.S. Pat. No. 4,367,981, issued to Shapiro, taught a drilling riser having a "slip joint" with an annular pressure chamber between flanged portions of an upper end that was attachable to a drilling platform.

SUMMARY OF THE INVENTION

In light of need for improvement of marine-riser tensioning, objects of this invention are to provide a controlled-pressure multi-cylinder riser tensioner which:

Provides direct control with effective vertical and lateral positioning of a riser;

Provides constancy of tension throughout vertically oscillational travel of a marine vessel from wave action in relation to a riser that is affixed to a seabed and tensioned vertically upward from the marine vessel;

Compensates for tensional variation from rolling and heaving action of waves on the marine vessel;

Positions a marine riser centrally in a moon pool while the marine vessel rolls and heaves from wave action;

Provides low center of gravity with balancing ballast on a marine vessel for use in all deep-water and shallow-water conditions;

Eliminates most downtime from adverse weather and wave conditions;

Provides long-range maintenance-free operation;

Has system redundancy with high reliability;

Is adaptable to standard blowout controls and fire protection;

Is operable automatically;

Can be operated manually;

Allows fast rig-up for riser-related operations;

Can be positioned not to occupy working deck space; and

Is relatively inexpensive in comparison to conventional riser tensioning.

This invention accomplishes these and other objectives with a controlled-pressure multi-cylinder riser tensioner having a plurality of preferably six control cylinders with top ends attached pivotally to a bottom surface of an operational floor and bottom ends attached pivotally to a riser-tensioner ring. Pressure lines in communication with opposite ends of the control cylinders lead to accumulators and to sources of pressure that are separately controlled automatically. Stroke length of the control cylinders is typically 50 feet for normal requirements but can be varied for particular operational requirements. Projection of the cylinders downwardly into a moon pool avoids their obstruction of work space on an operational floor of a vessel. Positioning pneumatic and hydraulic machinery below deck with tubing leading to the control cylinders lowers center of gravity for ballast effect of a seaworthy deep-water vessel. Each cylinder can have a separate pressurization system for reliability redundancy. An over-capacity for tensioning the riser with a portion of the control cylinders inactive or incapacitated increases reliability. Pressure transducers communicate pressure-change criteria to a central control system for coordinated automatic or optionally manual control of fluid pressure for each control cylinder separately.

BRIEF DESCRIPTION OF DRAWINGS

This invention is described by appended claims in relation to description of a preferred embodiment with reference to the following drawings which are described briefly as follows:

DESCRIPTION OF PREFERRED EMBODIMENT

Figure 2:
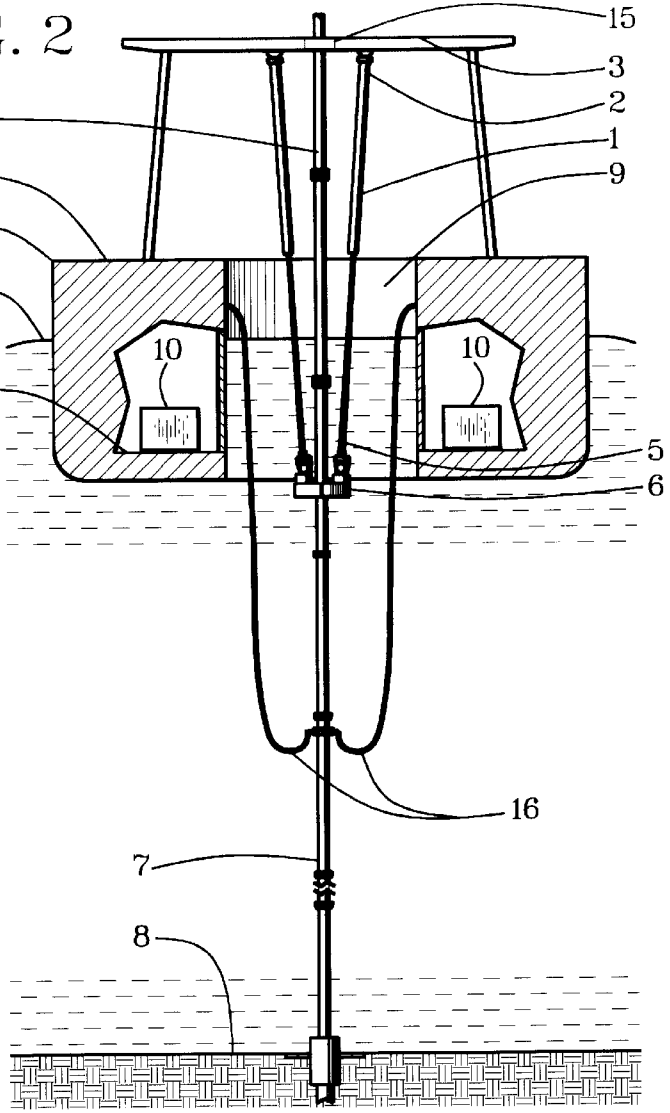
FIG. 2 is a partially cutaway end view through a moonpool section of a marine vessel on a crest of a wave.
Figure 1:
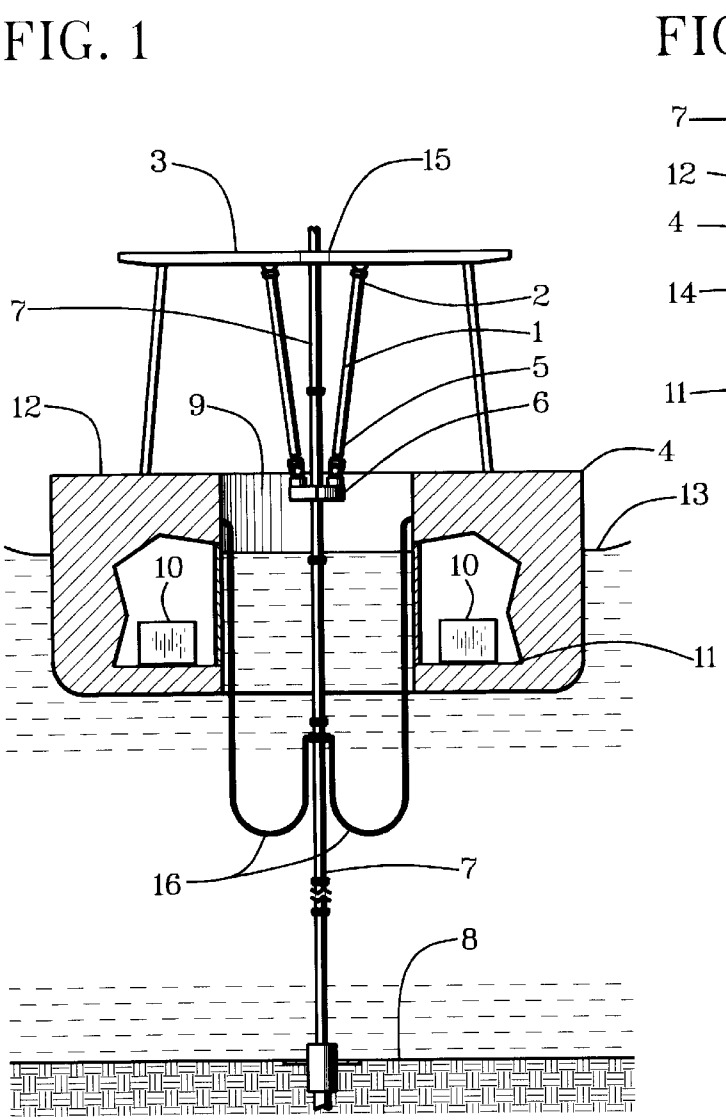
FIG. 1 is a partially cutaway end view through a moonpool section of a marine vessel in a valley of a wave.

Reference is made first to FIGS. 1–2. A plurality of preferably six or more control-cylinder units 1 have proximal ends 2 attached pivotally proximate a bottom of an operational floor 3 on a marine vessel 4. Distal ends 5 of the control-cylinder units 1 are attached pivotally to a riser-tensioner ring 6 to which a marine riser 7 is attachable with linear rigidity. The marine riser 7 is affixed to a seabed 8 by cementing, marine templates or other means and extended vertically to working relationship to a moon pool 9 over which the operational floor 3 or other operational floor is positioned in working relationship to a marine drill rig or other marine equipment that are not illustrated.

The control-cylinder units 1 are provided with separately controllable pressurized control fluid in fluid communication from pressurization mechanization 10 that can be placed in support positions 11 that are low on the marine vessel 4 and do not interfere with working space either on the operational floor 3, on a deck 12 of the marine vessel 4 or in the moon pool 9.

Pressurized control fluids in the control-cylinder units 1 provide selectively contractive pressures in directions from the distal ends 5 and towards the proximal ends 2 of the control-cylinder units 1. This tensions the marine riser 7 vertically upward with designedly constant upward pressure while the marine vessel 4 is positioned uncontrollably between wave valleys 13 depicted in FIG. 1 and wave crests 14 depicted in FIG. 2.

Constantly controllable upward pressure prevents the marine riser 7 from bending, buckling, falling or escaping from a working position in the moon pool 9 from wave-generated positioning, from weather-generated positioning or from other positioning of the marine vessel 4 in a working mode. Expandable and contractible length of the pressurized control-cylinder units 1 is typically 50 feet. This is sufficient for most ocean-wave conditions. Longer operational length can be provided for continuously safe working in extreme weather conditions with adequately designed and structured marine vessels 4. The most severe weather and wave conditions and the deepest oceans can be accommodated with this riser tensioner adapted to possibly V-bottomed, round-bottomed, multi-hulled or buoy-like marine vessels 4.

In addition to riser tensioning, a plurality of control-cylinder units 1 can be made to provide optimally lateral positioning of the marine riser 7 in working relationship to such items as drill stems, casing, drill-fluid connections and production lines that are placed in, conveyed through and removed from the marine riser 7 from a central position 15 on an operational floor 3. Lateral positioning is achieved by relative decrease of pressure in control-cylinder units 1 proximate edges of the moon pool 9 towards which lateral positioning is desired.

Riser tensioning with the control-cylinder units 1 is sufficiently compact to facilitate convenient use of protective items such as choke/kill lines 16 that are attached variously to blowout-prevention conveyances inside or outside of the marine riser 7. Less volume of this riser tensioner also facilitates application of fire-prevention systems and devices.

Figure 3:
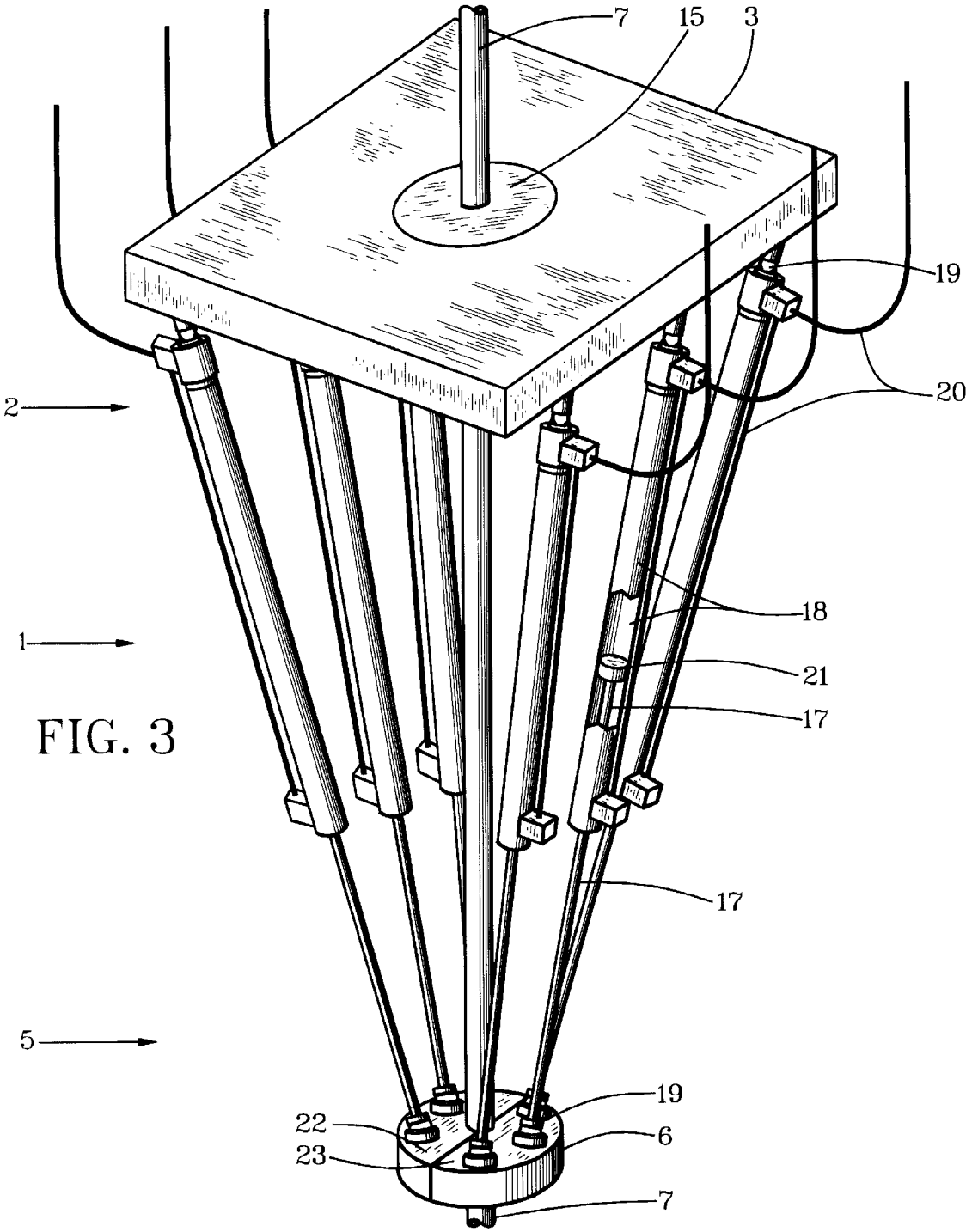
FIG. 3 is a partially cutaway perspective view of a cylinder section having single-cylinder units.

Referring to FIG. 3, the control-cylinder units 1 have piston rods 17 extendible selectively from cylinders 18. In a preferred embodiment, the piston rods 17 are attached pivotally with a ball-and-socket connection 19 to the riser-tensioner ring 6 at the distal end 5 and the cylinders 18 are attached with a ball-and-socket connection 19 to the operational floor 3 at the proximal ends 2 of the control-cylinder units 1. Pivotal connection of ends of the control-cylinder units 1 to the riser-tensioner ring 6 and/or to the bottom of the operational floor 3 can be with spherical bearings also in accordance with design preferences for particular use conditions. Fluid-pressure tubes 20 are routed to pressurized portions of the control-cylinder units 1. In this embodiment, pressurized portions of the control-cylinder units 1 are rod ends of the cylinders 18 where pressurized fluid forces pistons 21 on ends of the piston rods 17 upwardly to provide a lifting tension on the marine riser 7.

A wide variety of riser-tensioner rings 6 can be used with this riser tensioner. A preferred riser-tensioner ring 6, however, is a split type or a two-piece type with a first ring half 22 attachable to a second ring half 23 with means not described in this document that can be operated pneumatically, hydraulically, electrically or manually. The two portions of a split type of riser-tensioner ring 6 also can be hinged together on one side or attachable on both sides for different design preferences. Illustrative of fasteners generally for a split type of riser-tensioner ring 6 is a threaded fastener 24 shown in FIG. 4. Whichever fastener means is used on it, a split type of riser-tensioner ring 6 allows quick connection and disconnection, which can be quicker yet with a quick-disconnect fastener of various types in place of the illustrative threaded fastener 24. A quick-disconnect fastener can be a type which does not separate from the riser-tensioner ring 6, such that it cannot fall into the ocean. The threaded fastener 24 is shown only to illustrate attachableness of the first ring half 22 to the second ring half 23. Thorough description of riser-tensioning rings 6 and fastening means for them are not included in this document.

Figures 4, 5, 6:
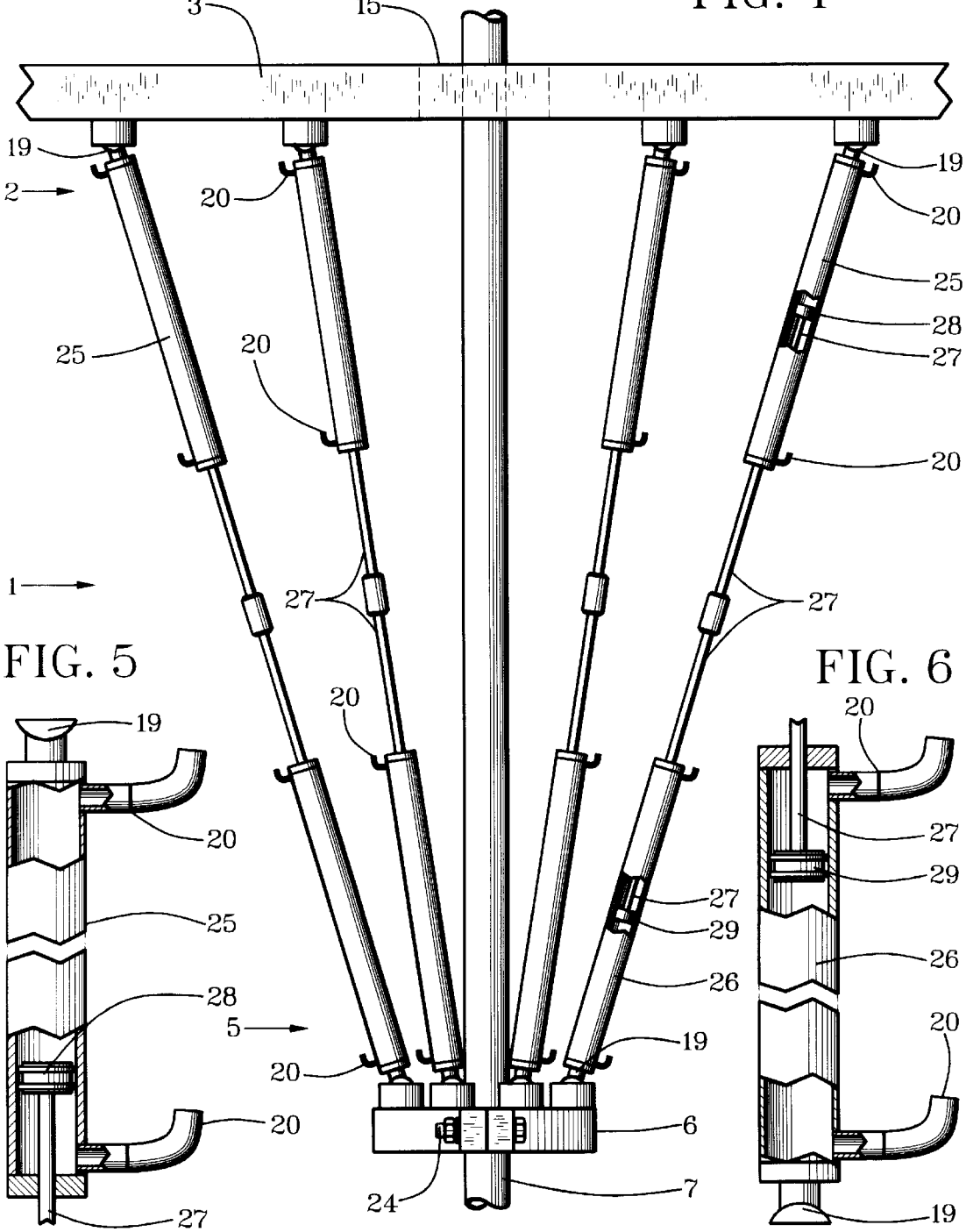
FIG. 4 is a partially cutaway side view of a cylinder section having dual cylinders with interconnected piston rods.
FIG. 5 is a partially cutaway side view of a top cylinder with pressure tubes at both ends.
FIG. 6 is a partially cutaway side view of a bottom cylinder with pressure tubes at both ends.
Figures 7, 8, 9:
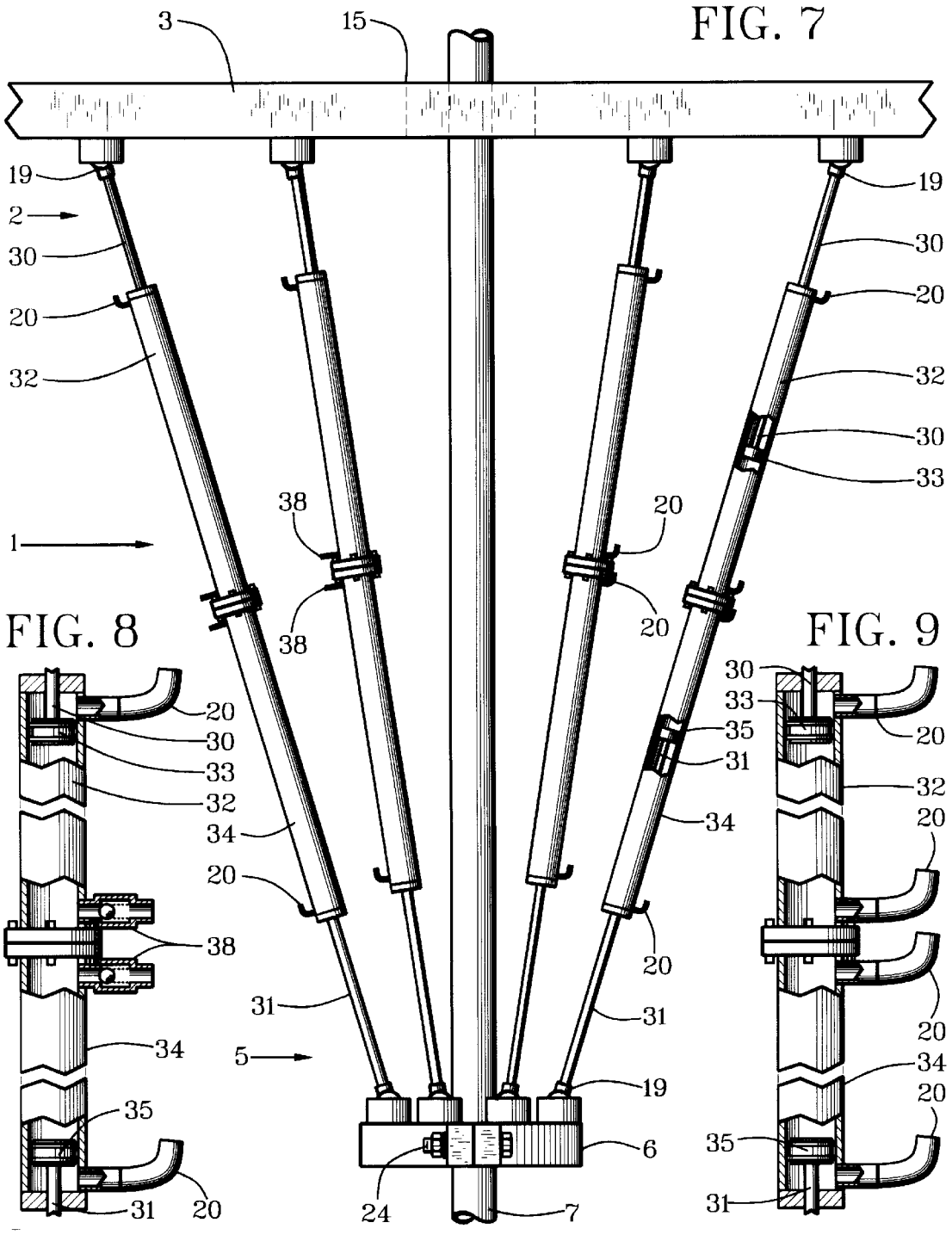
FIG. 7 is a partially cutaway side view of a cylinder section having linearly interconnected dual cylinders with top piston rods connected to operational-support structure and bottom piston rods connected to a riser-tensioner ring.
FIG. 8 is a partially cutaway side view of joined ends of cylinders having outlets at joined ends and two-way conveyances at rod ends.
FIG. 9 is a partially cutaway side view of joined ends of cylinders having two-way conveyances at joined ends and at rod ends.
Figure 10:
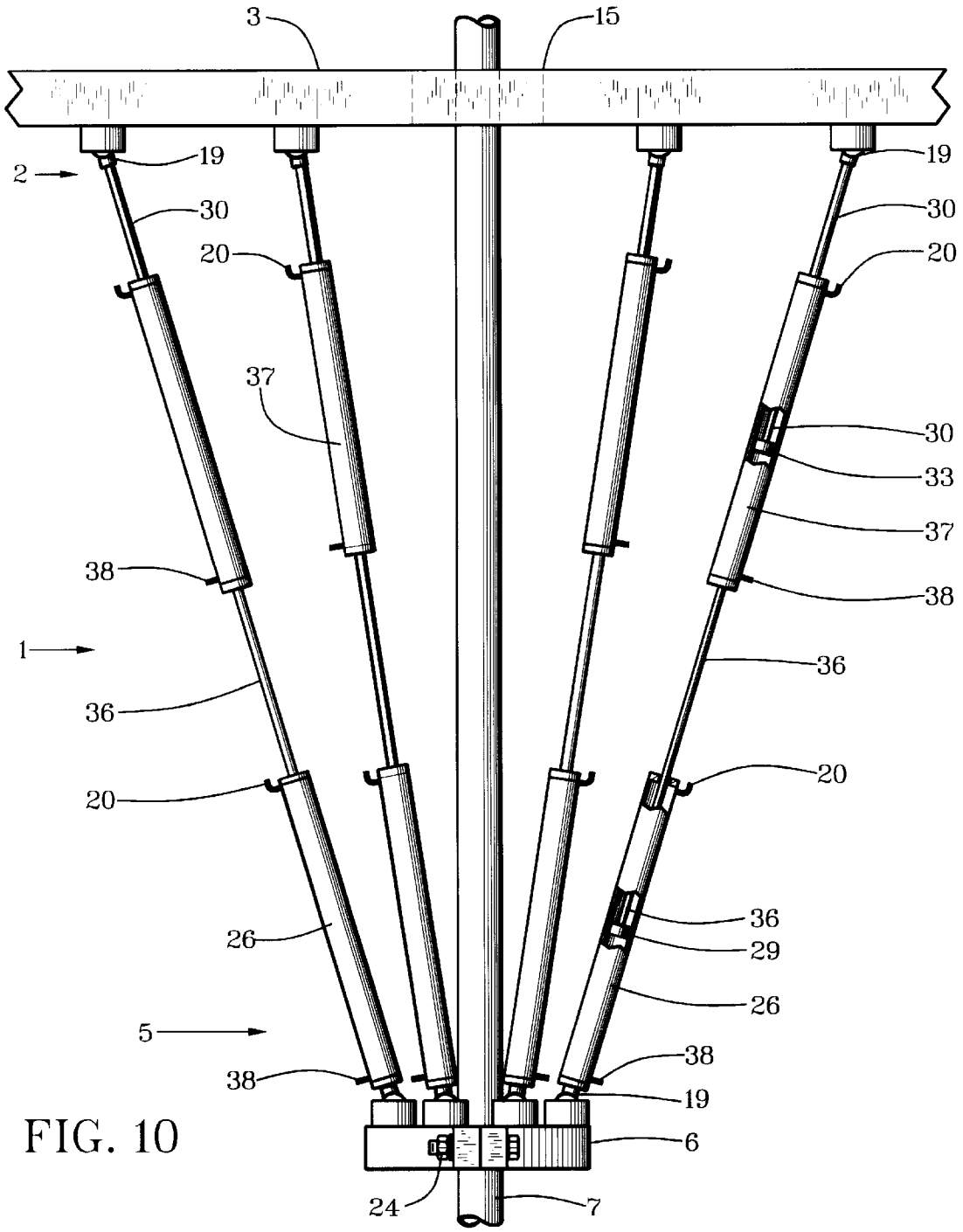
FIG. 10 is a partially cutaway side view of a cylinder section having dual cylinders with top piston rods connected to operational-support structure and bottom cylinders connected to a riser-tensioner ring.
Figure 11:
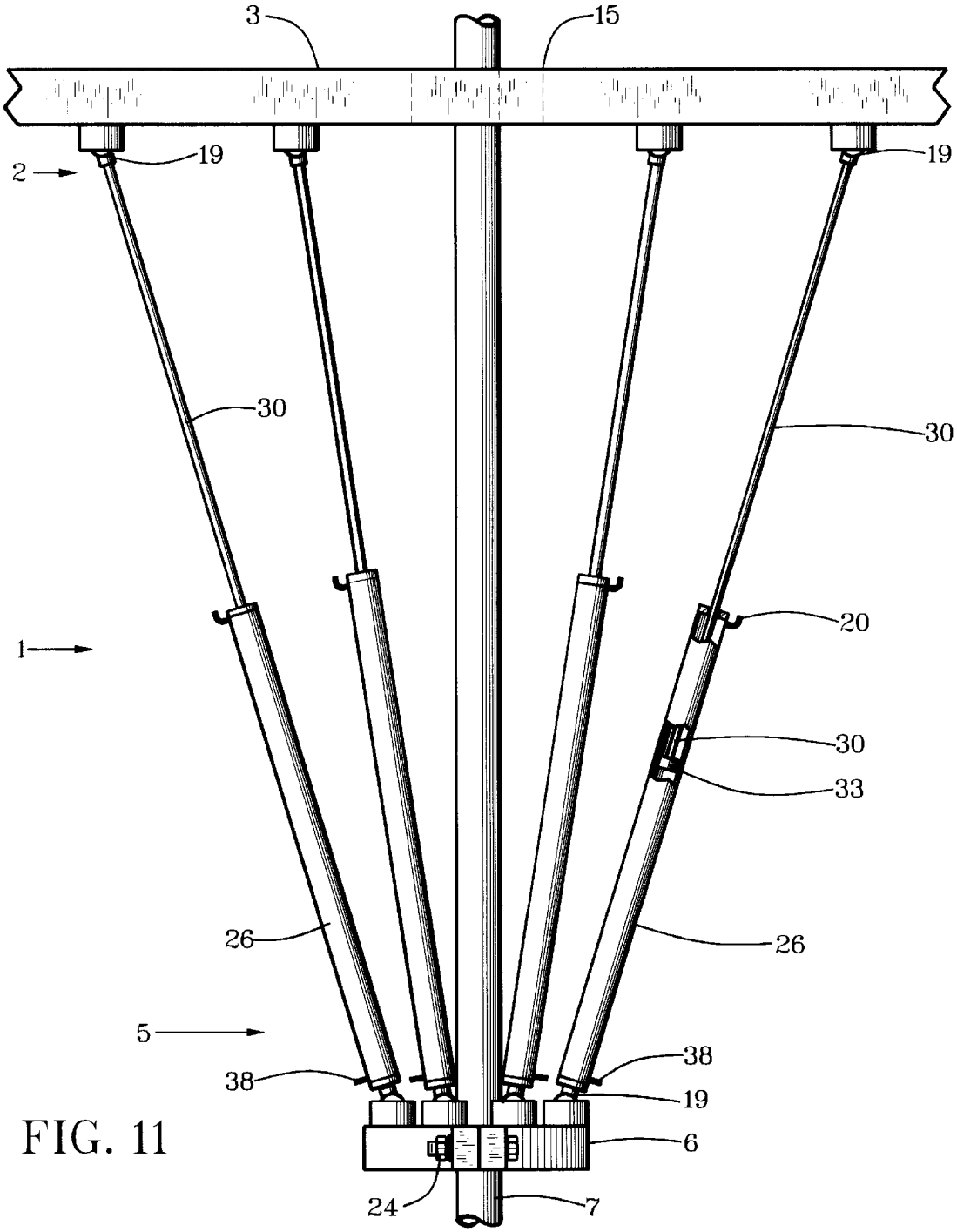
FIG. 11 is a partially cutaway side view with piston rods attached pivotally to operational-support structure and cylinders attached pivotally to a riser-tensioner ring.

Referring to FIGS. 4–11, the control-cylinder units 1 can have a variety of forms and related pressurization features. FIG. 4 depicts top cylinders 25 joined pivotally to the operational floor 3 and bottom pistons 26 joined pivotally to the riser-tensioner ring 6. They are joined by an interconnecting rod 27 having a top piston 28 and a bottom piston 29 respectively. FIG. 7 depicts a top piston rod 30 attached pivotally to the operational floor 3 and a bottom piston rod 31 attached pivotally to the riser-tensioner ring 6. A top interconnected cylinder 32 has a top-cylinder piston 33 on the top piston rod 30. A bottom interconnected cylinder 34 has a bottom-cylinder piston 35 on the bottom piston rod 31. FIG. 10 depicts a top piston rod 30, as shown in FIG. 7, attached pivotally to the operational floor 3 and a bottom cylinder 26, as shown in FIG. 4, attached pivotally to the riser-tensioner ring 6. Differently in this embodiment, however, a cylinder-extension piston rod 36 is attached to a bottom piston 29 and to a blind-end bottom of a floating cylinder 37. FIG. 11 depicts a top piston rod 30 attached pivotally to the operational floor 3 and a bottom piston 26 attached pivotally to the riser-tensioner ring 6 in opposite relationship to the FIG. 3 illustration. Other variants of control-cylinder units 1 are foreseeable within the scope of this invention. However, the preferred type depicted in FIG. 3 can be structured appropriately for most applications and use conditions.

Referring to FIGS. 3–11, fluid-pressure tubes 20 and fluid-return lines 38 can be structured appropriately for different types of control-cylinder units 1, for different use conditions, for different pressure fluids and for different applications. In FIGS. 4–6, fluid-pressure tubes 20 are shown at both ends of top cylinder 25 and bottom cylinder 26. Appropriate control valves, pressurization means, pressure accumulators, safety valves and conveyance tubes beyond ends of the fluid-pressure tubes 20 shown in these sectional drawings are assumed for particular pneumatic and hydraulic embodiments of this invention. In FIG. 8 and in a left-side portion of FIG. 7, fluid-pressure tubes 20 are shown at rod ends of top interconnected cylinder 32 and bottom interconnected cylinder 34 while fluid-return lines 38 are shown at interconnecting blind ends of the same cylinders 32 and 34. The fluid-return lines 38 are depicted as having pressure-relief valves, although this type of valve is only representative of pressure-release valves in general that can be operated with means other than a spring as depicted. In a right-side portion of FIG. 7 and in FIG. 9, fluid-pressure tubes 20 are shown at both ends of the top interconnected cylinder 32 and the bottom interconnected cylinder 34 to demonstrate selectiveness of combinations of components of different embodiments of the control-cylinder units 1. In FIG. 10, fluid-pressure tubes 20 are positioned in fluid communication with piston-rod ends of the bottom cylinders 26 and the floating cylinders 37.

Essential to positioning of fluid-pressure tubes 20 is direction of pressurized fluid through them to raise distal ends 5 of the control-cylinder units 1 vertically in order to provide vertically upward tension on the marine riser 7 controllably and selectively by raising and/or laterally positioning the riser-tensioner ring 6 to which the marine riser 7 is attached with linear rigidity. To raise distal ends 5 of the control-cylinder units 1, pressurized fluid is directed controllably into pressurized portions of cylinders 18, 25, 26, 32, 34 and/or 37, regardless of how or whether a fluid-return line 38 is employed for different types of pressurization fluids and applications of this invention.

Figure 12:
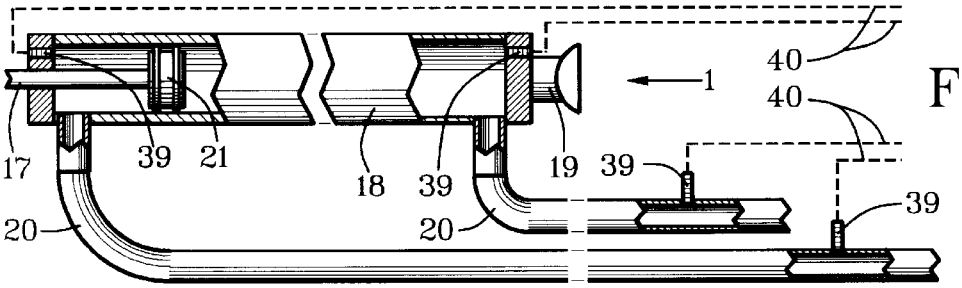
FIG. 12 is a partially cutaway side view of a cylinder having pressure transducers with control leads from optionally both ends of the cylinder and from two-way conveyances from both ends of the cylinder.
Figure 14:
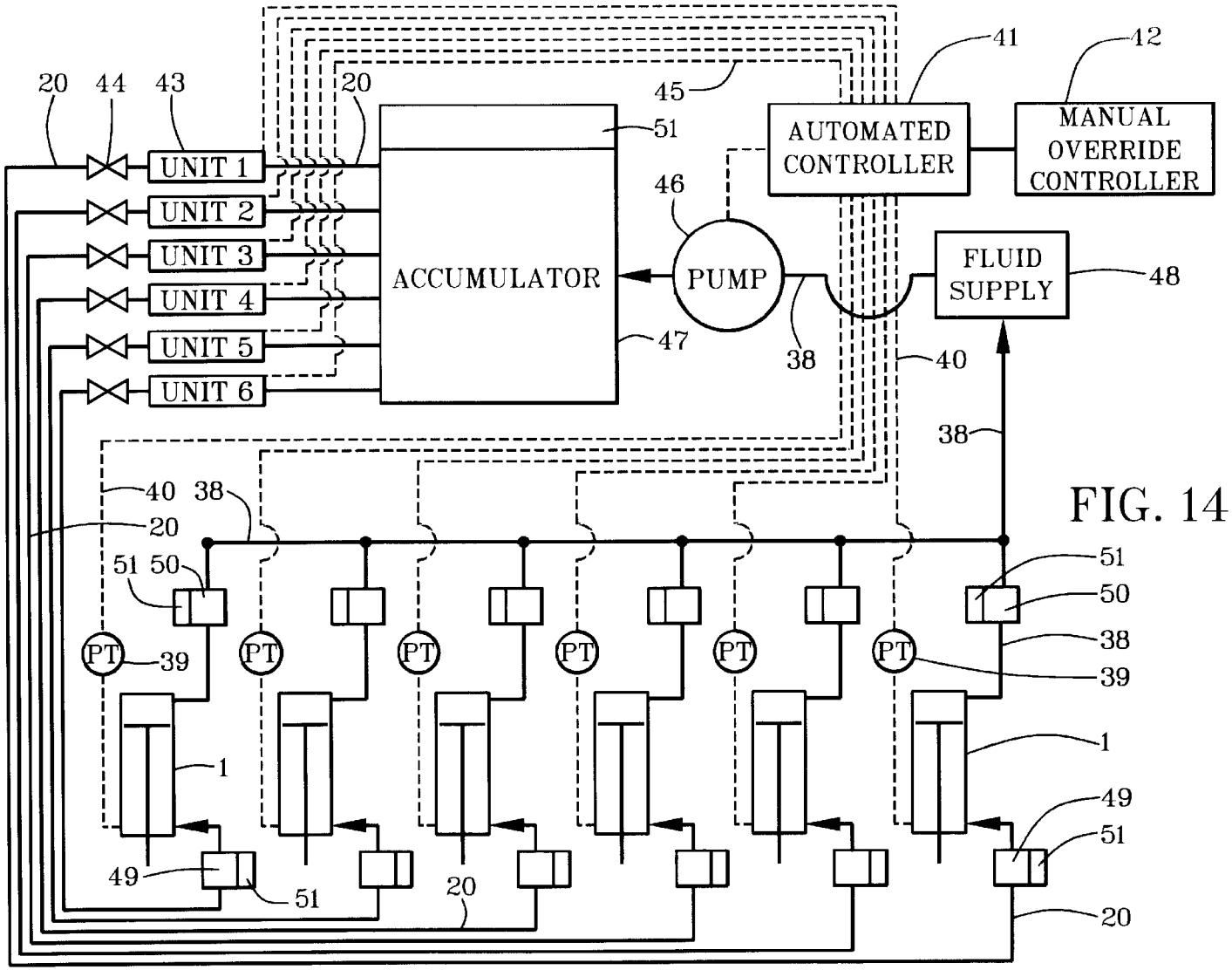
FIG. 14 is a schematic diagram of the controlled-pressure multi-cylinder riser tensioner with optionally liquid or gas fluid for pressurizing a central pressure unit.
Figure 15:
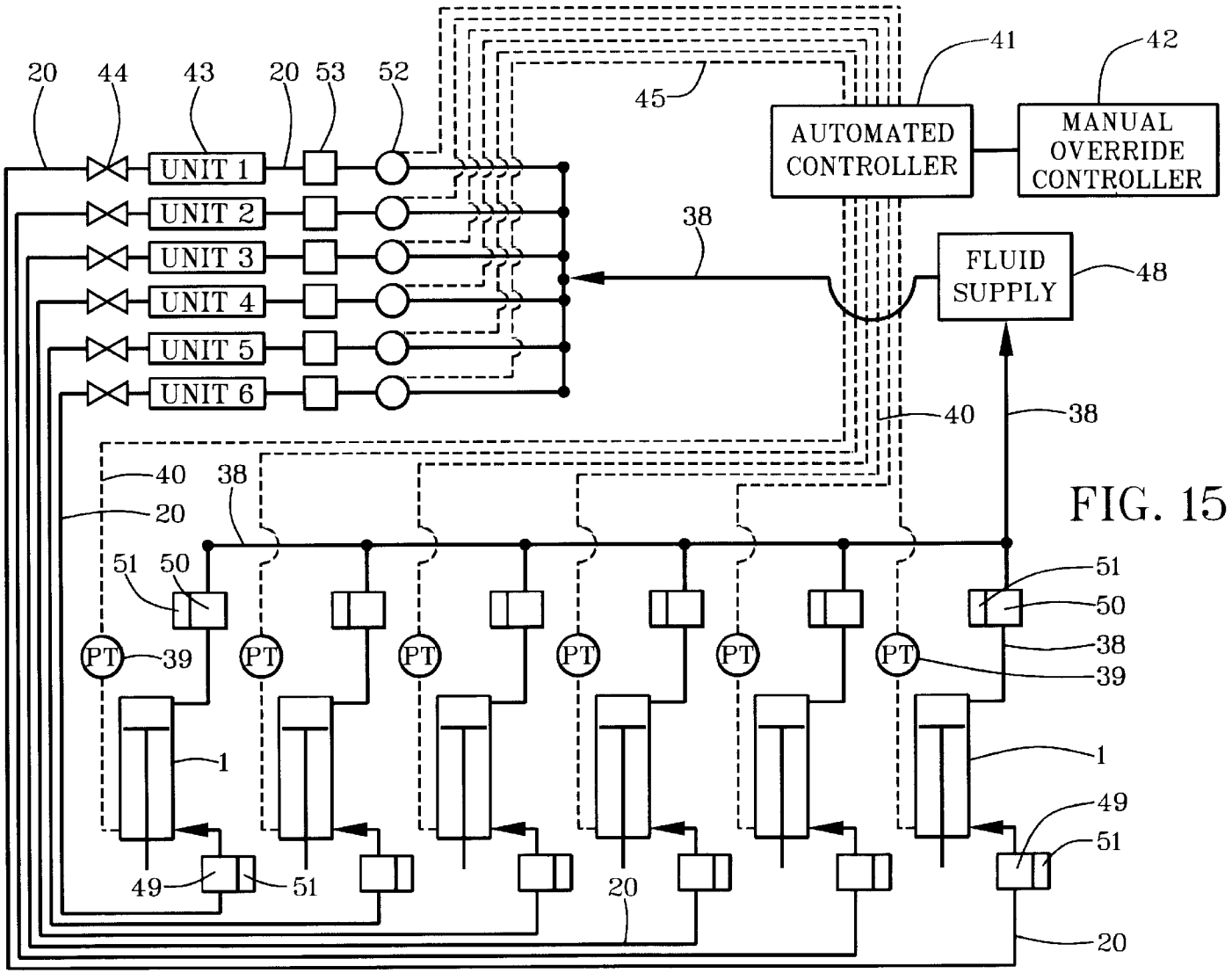
FIG. 15 is a schematic diagram of the controlled-pressure multi-cylinder riser tensioner with optionally liquid or gas fluid for pressurizing separate pressure units.
Figure 16:
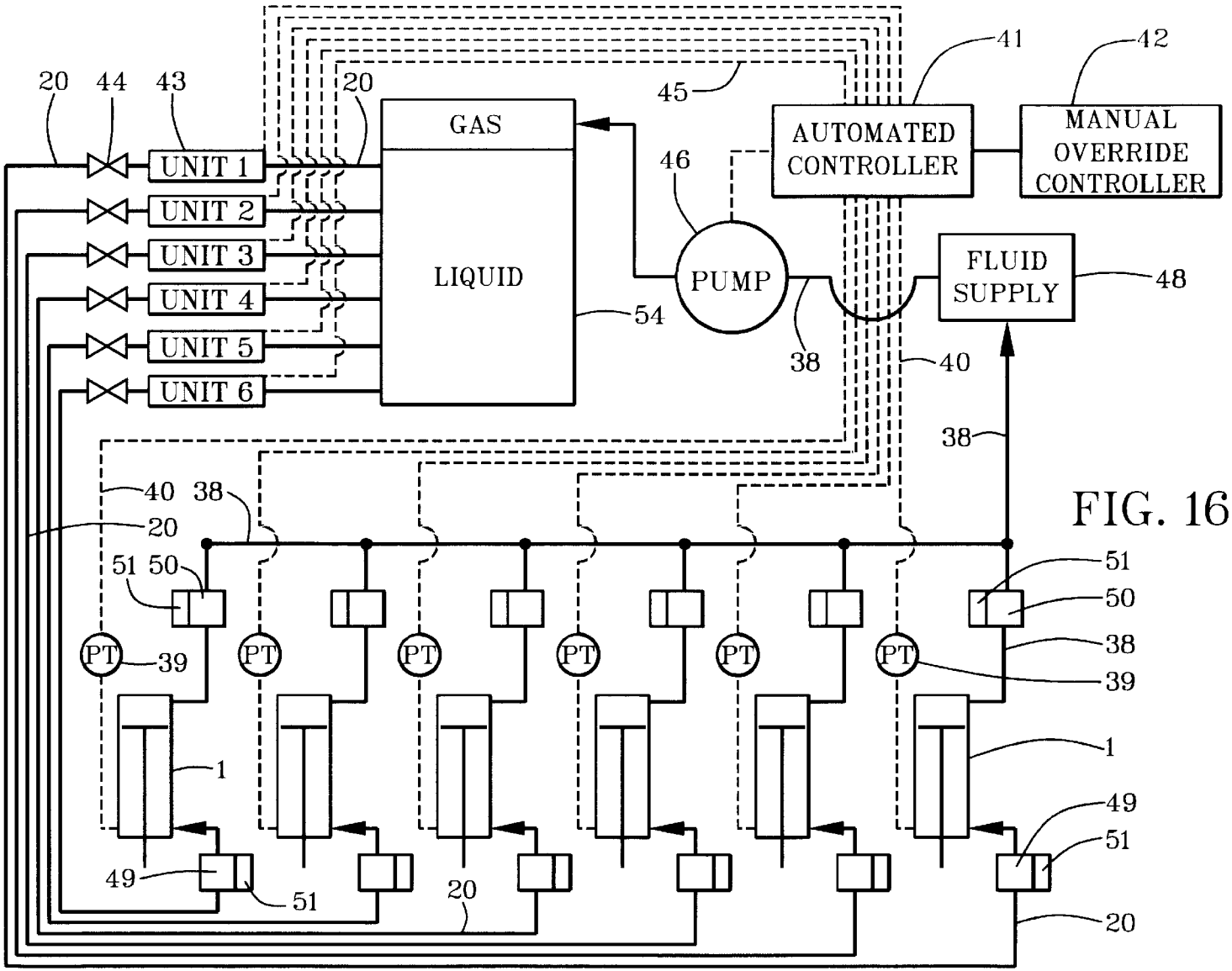
FIG. 16 is a schematic diagram of the controlled-pressure multi-cylinder riser tensioner with a combination of gas and liquid fluids for pressurizing separate pressurization units.

Referring to FIG. 12, pressure transducers 39 in pressure-indicative communication from pressurized portions of the control-cylinder units 1 have control-input lines 40 leading to an automated controller 41 shown in FIGS. 14–16. The pressure transducers 39 can be in pressure-indicative communication directly with pressurized portions of the control-cylinder units 1 and/or with fluid-pressure tubes 20 at positions in the fluid-pressure tubes 20 where pressure readings are not significantly different than at the control-cylinder units 1 directly.

The automated controller 41 and the manual-override controller 42 are in proximity to and operated in relation to a driller's control panel with a plurality of operating stations throughout a vessel for safety redundance at select safety positions.

Figure 13:
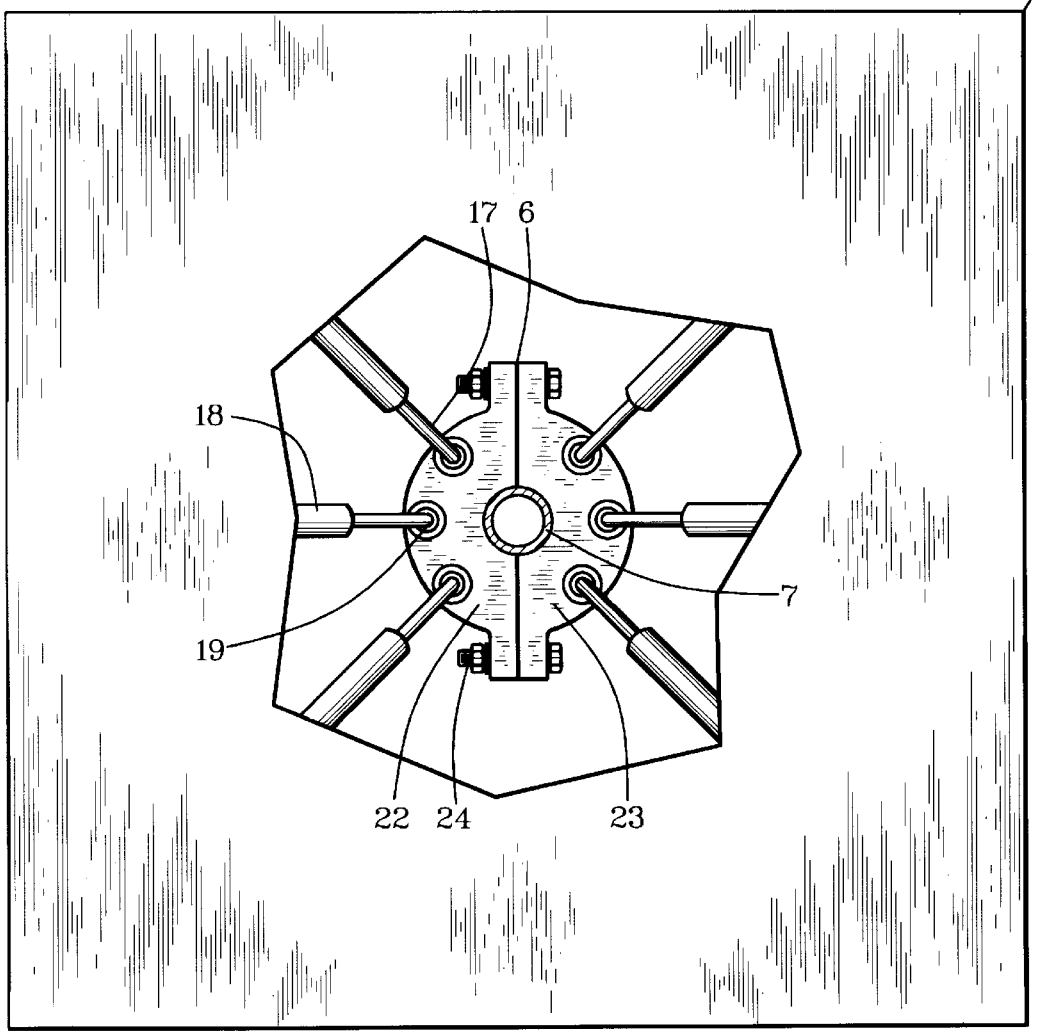
FIG. 13 is a partially cutaway plan view of a cylinder section in relationship to an operational floor and a riser-tensioner ring.

Referring to FIG. 13, the riser-tensioner ring 6 can be pressured vertically upward towards the operational floor 3 and from-side-to-side in any direction laterally in order to tension the marine riser 7 while maintaining it in a desired position centrally by appropriate pressurization of cylinders 18 from which piston rods 17 are extended to pivotal attachment to the riser-tensioner ring 6.

Referring to FIGS. 14–16 and referring further to FIGS. 1–2 also, the separately controllable means of supply of pressurized control fluid has an automated controller 41 with which supply of pressurized control fluid is directed through accumulators 49 to pressurized portions of control-cylinder units 1 at pressures and volumes to achieve select vertically upward tension on the riser 7 in controlled reaction to wave-generated positioning, weather-generated positioning and otherwise caused positioning of the marine vessel 4 in relationship to a length of tensioned marine riser 7 having a proximal end 2 that is attached to the riser-tensioner ring 6 and a distal end 5 that is affixed to a seabed 8. A manual-override controller 42 can be positioned at a local control panel to adjust and to override-control the automated controller 41.

Control-input lines 40 can be employed to convey pressure data from pressure transducers 39, described also in relation to FIG. 12, for the automated controller 41 to determine pressure requirements for communication to centrally controlled valve units 43 to direct an appropriate level of pressure and/or volume of pressurized control fluid through control-unit valves 44 for conveyance in fluid-pressure tubes 20 to pressurized portions of the control-cylinder units 1. Control communication is conveyed from the automated controller 41 and/or the manual-override controller 42 to the centrally controlled valve units 43 through control-output lines 45.

Controllably variable fluid volume at select pressures for effective riser tensioning can be supplied to the control-cylinder units 1 without pressure requirements being indicated by the pressure transducers 39. The pressure transducers 39 can be used primarily to indicate emergency conditions such as a riser break that require special pressurization. A basic control loop without the pressure transducer is the same as indicated in FIGS. 13–16, however, because pressure and volume of fluid to be supplied are determined by pressure in the control-cylinder units 1.

For a central-pump embodiment delineated in FIG. 14, a central pump 46 can be provided to pressurize a centralized-pressure accumulator 47 from which all pressurized control fluid in proportions directed by the automated controller 41 for release into fluid-pressure tubes 20 by the centrally controlled valve units 43 through control-unit valves 44. A fluid-supply source 48 can be provided for supply of fluid to the central pump 46.

To an extent that and in such manner as fluid is returned from the control-cylinder units 1 in a closed-loop system as delineated in FIGS. 14–16, the fluid is directed back to the fluid-supply source 48 through the fluid-return lines 38 and re-pressurized with the central pump 46.

Input accumulators 49 in the fluid-pressure tubes 20 and return accumulators 50 in fluid-return lines 38 can be provided with expansion absorbers 51 appropriate for pneumatic use or for hydraulic use of this invention in accordance with design preferences. Also in accordance with design preferences, the centralized-pressure accumulator 47 can be constructed for either pneumatic use or hydraulic use with an appropriate expansion absorber 51. The central pump 46, the fluid-pressure tubes 20, the fluid-return lines 38, the control-unit valves 44 and related hardware are assumed to be designed and/or selected in accordance with known requirements for either pneumatic or hydraulic uses.

As represented in FIG. 15, the separately controllable means of supply of pressurized control fluid can have separately controlled pumps 52 and separate accumulators 53 as an option to the central pump 46 and centralized-pressure accumulator 47 described in relation to FIG. 14. The control-output lines 45 are then in control communication with the separately controlled pumps 52 and any return fluid is redirected to the separately controlled pumps 52 through fluid-return lines 38. This provides an additional level of redundancy for increased reliability if preferred.

Optional to being hydraulic or pneumatic, pressurization of the control-cylinder units 1 can be partly hydraulic and partly pneumatic by employing pressurized gas to apply pressure to liquid with a pressure converter 54 such as a dual-fluid pressure tank as diagramed in FIG. 16.

Figure 17:
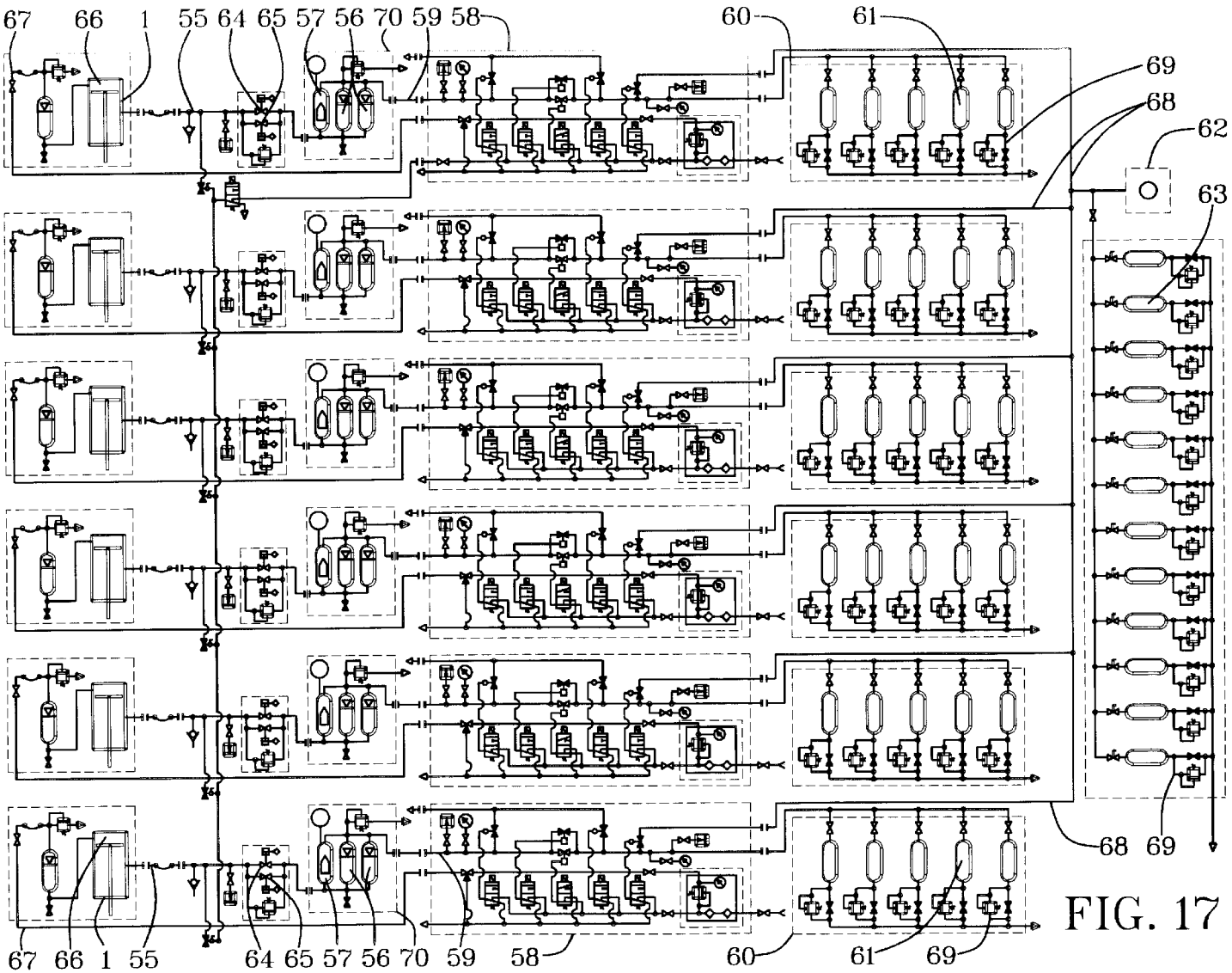
FIG. 17 is a detailed diagram of a preferred embodiment of the FIG. 16 illustration.

Referring to FIG. 17, a preferred dual-fluid means of supply of pressurized control fluid to the control-cylinder units 1 has a comprehensive working relationship of pneumatic and hydraulic components with pluralities of backup duplicity and safety features that can be included within the FIG. 16 diagram. A preferred plurality of six control-cylinder units 1 have liquid conveyances 55 in fluid communication intermediate a duplicity of pressure-conversion vessels 56 and the control-cylinder units 1. Level indicators 57 communicate pressure and volume factors for determining rate of gas pressurization through gas conveyances 59 from air-pressure groups 60 having pluralities of group pressure vessels 61 that are preferably five 22-inch-diameter pressure vessels. Gas pressure, which is air pressure in this instance, is provided to the group pressure vessels 61 by a compressor unit 62 with which air is pressurized and stored in a plurality of backup-pressure vessels 63 that are preferably twelve 24-inch-diameter pressure vessels.

The plurality of backup-pressure vessels 63 provide central storage of high volumes of compressed air for rapid availability for pressurizing a plurality of air-pressure groups 60 of group pressure vessels 61 for pressurizing a plurality of accumulator banks 70 of pressure-conversion vessels 56 to meet tensioning demands of a plurality of control-cylinder units 1.

Rate of flow of liquid under pressure through liquid conveyances 55 is regulated with a preferably six-inch large valve 64 and a preferably two-inch small valve 65 in each liquid conveyance 55. The tensioner valve panel 58 through which flow through the large valve 64 and the small valve 65 are regulated is represented broadly by the automated controller 41 and the manual-override controller 42 described in relation to FIGS. 14–16.

Low-pressure air is conveyed intermediate low-pressure ends 66 of the control-cylinder units 1 and the tensioner valve panel 58 through return gas lines 67. Any liquid mixed with air is removed en route to control components at the tensioner valve panel 58.

High-pressure air is conveyed through high-pressure lines 68 from the compressor unit 62 and the backup pressure vessels 63 en route to the gas conveyances 59. Then it is routed to the pressure-conversion vessels 56 and the group pressure vessels 61. Safety outlets 69 with appropriate valves and lines are provided for the group pressure vessels 61 and the backup pressure vessels 63.

The pressure-conversion vessels 56 are proximate accumulator banks 70 where gas pressure is directed against liquid which is routed to pressurized portions of the control-cylinder units 1.

Downward pressure from weight and nominal elasticity of the marine riser 6 is resistance pressure against entry of control fluid into pressurized portions of the control-cylinder units 1. Consequently, there is no need for two-way pressurization of the control-cylinder units 1 for either hydraulic, pneumatic or combined hydraulic and pneumatic fluids.

Hydraulic and pneumatic symbols known to those skilled in the pertinent art are shown to indicate related design features such as select valves, pressure indicators conveyances and joints. Additional detail of the automated controller 41 and the manual-override controller 42, however, are not explained in this document.

A new and useful controlled-pressure multi-cylinder riser tensioner having been described, all such foreseeable modifications, adaptations, substitutions of equivalents, mathematical possibilities of combinations of parts, pluralities of parts, applications and forms thereof as described by the following claims and not precluded by prior art are included in this invention.

LIST OF NUMBERED COMPONENTS
(For convenience of the Examiner)

1. Control-cylinder units
2. Proximal ends
3. Operational floor
4. Marine vessel
5. Distal ends
6. Riser-tensioner ring
7. Marine riser
8. Seabed
9. Moon pool
10. Pressurization mechanism
11. Ballasting positions
12. Deck
13. Wave valleys
14. Wave crests
15. Central position
16. Choke/kill lines
17. Piston rods
18. Cylinders
19. Ball-and-socket connection
20. Fluid-pressure tubes
21. Pistons
22. First ring half
23. Second ring half
24. Threaded fastener
25. Top cylinder
26. Bottom cylinder
27. Interconnecting rod
28. Top piston
29. Bottom piston
30. Top piston rod
31. Bottom piston rod
32. Top interconnected cylinder
33. Top-cylinder piston
34. Bottom interconnected cylinder
35. Bottom-cylinder piston
36. Cylinder-extension piston rod
37. Floating cylinder
38. Fluid-return lines
39. Pressure transducers
40. Control-input lines
41. Automated controller
42. Manual-override controller
43. Centrally controlled valve units
44. Control-unit valves
45. Control-output lines
46. Central pump
47. Centralized-pressure accumulator
48. Fluid-supply source
49. Input accumulators
50. Return accumulators
51. Expansion absorbers
52. Separately controlled pumps
53. Separate accumulators
54. Pressure converter
55. Liquid conveyances
56. Pressure-conversion vessels
57. Level indicators
58. Tensioner valve panel
59. Gas conveyances
60. Air-pressure groups
61. Group pressure vessels
62. Compressor unit
63. Backup-pressure vessels
64. Large valve
65. Small valve
66. Low-pressure ends
67. Return gas lines
68. High-pressure lines
69. Safety outlets
70. Accumulator banks

What is claimed is:

1. A controlled-pressure multi-cylinder riser tensioner comprising:

a plurality of control-cylinder units having proximal ends attached pivotally to a marine vessel proximate a bottom of an operational floor on the marine vessel;

the plurality of control-cylinder units having distal ends attached pivotally to a riser-tensioner ring;

fluid-pressure tubes in fluid communication intermediate pressurized portions of the control-cylinder units and separately controllable means of supply of pressurized control fluid to the pressurized portions of the control cylinders;

pressure transducers in pressure-indicative communication between pressurized portions of the control-cylinder units and the separately controllable means of supply of pressurized control fluid to the pressurized portions of the control-cylinder units; and the separately controllable means of supply of pressurized control fluid being controllable to supply pressurized control fluid for varying output of tensional force of separate control-cylinder units at pressures and volumes that achieve vertically upward tension of control-cylinder units selectively in controlled reaction to wave-generated positioning, weather-generated positioning and otherwise caused positioning of the marine vessel in relationship to a length of marine riser having a proximal end that is attached to the riser-tensioner ring and a distal end that is affixed to a seabed.

2. A controlled-pressure multi-cylinder riser tensioner as described in claim 1 wherein:

the pressure transducers are positioned in pressure-detective communication with inside peripheries of the fluid-pressure tubes for pressure-indicative communication between fluid pressure existing in the pressurized portions of the control-cylinder units and the separately controllable means of supply of pressurized control fluid to the pressurized portions of the control-cylinder units.

3. A controlled-pressure multi-cylinder riser tensioner as described in claim 1 wherein:

the pressure transducers are positioned in pressure-detective communication with inside peripheries of the pressurized portions of the control-cylinder units directly for direct pressure-indicative communication between fluid pressure existing in the pressurized portions of the control-cylinder units and the separately controllable means of supply of pressurized control fluid to the pressurized portions of the control-cylinder units.

4. A controlled-pressure multi-cylinder riser tensioner as described in claim 1 wherein:

the separately controllable means of supply of pressurized fluid are controllable automatically with automated controllers having predetermined automated responses to pressure-indicative communications from the pressure transducers.

5. A controlled-pressure multi-cylinder riser tensioner as described in claim 1 wherein:

the separately controllable means of supply of pressurized fluid are controllable manually with at least one manual-override controller that provides predetermined control responses to pressure-indicative communications from the pressure transducers.

6. A controlled-pressure multi-cylinder riser tensioner as described in claim 1 and further comprising:

proximal-end fluid-pressure tubes in fluid communication intermediate proximal ends of control-cylinder units and separately controllable means of supply of pressurized control fluid to the proximal ends of the control-cylinder units;

distal-end fluid-pressure tubes in fluid communication intermediate distal ends of control-cylinder units and separately controllable means of supply of pressurized control fluid to the distal ends of the control-cylinder units;

the proximal-end fluid-pressure tubes are in fluid communication with the distal-end pressurized-fuel tubes through separately controllable means of supply of pressurized control fluid; and the separately controllable means of supply of pressurized fluid are controllable automatically for pressurization of distal ends and proximal ends of the control-cylinder units.

7. A controlled-pressure multi-cylinder riser tensioner as described in claim 1 wherein:

the control-cylinder units have control cylinders with blind-cylinder proximal ends attached pivotally to a marine vessel proximate a bottom of an operational floor on the marine vessel;

the control cylinders each have a piston in sliding-seal contact with an inside periphery of each of the control cylinders, such that a plurality of pistons equal to the plurality of control cylinders are in sliding-seal contact with inside peripheries of the control cylinders respectively;

proximal ends of piston rods are affixed to rod sides of the pistons respectively;

the piston rods have distal ends attached pivotally to the riser-tensioner ring;

the control cylinders have rod-end cylinder heads with which the piston rods are in sliding-seal contact;

the fluid-pressure tubes are in fluid communication intermediate the distal ends of the control cylinders and the separately controllable means of supply of pressurized control fluid to the distal ends of the control cylinders; and the pressure transducers are in pressure-indicative communication between fluid pressures existing in the distal ends of the control cylinders and the separately controllable means of supply of pressurized control fluid to the distal ends of the control cylinders.

8. A controlled-pressure multi-cylinder riser tensioner as described in claim 7 and further comprising:

fluid-pressure tubes in fluid communication intermediate the proximal ends of the control cylinders and separately controllable means of supply of pressurized control fluid to the proximal ends of the control cylinders;

pressure transducers in pressure-indicative communication between fluid pressures existing in the proximal ends of the control cylinders and the separately controllable means of supply of pressurized control fluid to the proximal ends of the control cylinders; and the separately controllable means of supply of pressurized fluid being controllable to supply pressurized control fluid with selectively constant pressures to proximal ends of control cylinders.

9. A controlled-pressure multi-cylinder riser tensioner as described in claim 1 wherein:

the control-cylinder units have control cylinders with blind-cylinder proximal ends attached pivotally to a riser-tensioner ring;

the control cylinders each have a piston in sliding-seal contact with an inside periphery of each of the control cylinders, such that a plurality of pistons equal to the plurality of control cylinders are in sliding-seal contact with inside peripheries of the control cylinders respectively;

proximal ends of piston rods are affixed to rod sides of the pistons respectively;

the piston rods have distal ends attached pivotally to a marine vessel proximate a bottom of an operational floor on the marine vessel;

the control cylinders have rod-end cylinder heads with which the piston rods are in sliding-seal contact proximate distal ends of the control cylinders;

the fluid-pressure tubes are in fluid communication intermediate the distal ends of the control cylinders and the separately controllable means of supply of pressurized control fluid to the distal ends of the control cylinders;

the pressure transducers are in pressure-indicative communication between fluid pressures existing in the distal ends of the control cylinders and the separately controllable means of supply of pressurized control fluid to the distal ends of the control cylinders; and the separately controllable means of supply of pressurized fluid are controllable to supply pressurized control fluid with selectively constant pressures to distal ends of control cylinders.

10. A controlled-pressure multi-cylinder riser tensioner as described in claim 1 wherein:

the control-cylinder units are end-to-end linearly opposed pairs of control cylinders having first control cylinders on which are first blind-cylinder ends and second control cylinders on which are second blind-cylinder ends;

the first blind-cylinder ends on the first control cylinders are attached pivotally to a marine vessel proximate a bottom of an operational floor on the marine vessel;

the second blind-cylinder ends on the second control cylinders are attached pivotally to a riser-tensioner ring;

the first control cylinders have first-cylinder distal ends with rod-end heads through which top piston rods are extended in sliding-seal contact;

the second control cylinders have second-cylinder distal ends with rod-end heads through which bottom piston rods are extended in sliding-seal contact;

the top piston rods are attached to first pistons which are in sliding-seal contact with an inside periphery of the first control cylinders;

the bottom piston rods are attached to second pistons which are in sliding-seal contact with an inside periphery of the second control cylinders; and the top piston rods and the bottom piston rods have attachment ends with which the top piston rods and the bottom piston rods are attached end-to-end linearly.

11. A controlled-pressure multi-cylinder riser tensioner as described in claim 1 wherein:

the control-cylinder units are end-to-end linearly opposed pairs of control cylinders having first control cylinders on which are first blind-cylinder ends and second control cylinders on which are second blind-cylinder ends;

the first blind-cylinder ends on the first control cylinders are attached end-to-end linearly to the second blind-cylinder ends on the second control cylinders;

the first control cylinders have first-cylinder distal ends with rod-end heads through which top piston rods are extended in sliding-seal contact;

the second control cylinders have second-cylinder distal ends with rod-end heads through which bottom piston rods are extended in sliding-seal contact;

the top piston rods are attached to first pistons which are in sliding-seal contact with an inside periphery of the first control cylinders;

the bottom piston rods are attached to second pistons which are in sliding-seal contact with an inside periphery of the second control cylinders; and the top piston rods and the bottom piston rods have attachment ends with which the top piston rods are attached pivotally to a marine vessel proximate a bottom of an operational floor on the marine vessel and the bottom piston rods are attached the riser-tensioner ring.

12. A controlled-pressure multi-cylinder riser tensioner as described in claim 1 wherein:

the riser-tensioner ring is a split type having a first half-cylinder portion of a riser-attachment orifice in a first side and having a second half-cylinder portion of the riser-attachment orifice in a second side of the riser-tensioner ring.

13. A controlled-pressure multi-cylinder riser tensioner as described in claim 1 wherein:

pivotal attachment of the control-cylinder units to the marine vessel is with ball-and-socket joints.

14. A controlled-pressure multi-cylinder riser tensioner as described in claim 1 wherein:

pivotal attachment of the control-cylinder units to the riser-tensioner ring is with ball-and-socket joints.

15. A controlled-pneumatic marine-riser tensioner as described in claim 1 wherein:

the separately controllable means of supply of pressurized control fluid has separately controlled valve units in centrally controlled fluid communication intermediate a central pump and the control-cylinder units; and the central pump is positioned in fluid communication from a fluid-supply source.

16. A controlled-pneumatic marine-riser tensioner as described in claim 15 and further comprising:

a central accumulator in fluid communication intermediate the central pump and the centrally controlled valve units.

17. A controlled-pneumatic marine-riser tensioner as described in claim 1 wherein:

the separately controllable means of supply of pressurized control fluid has separately controlled pumps and valve units in centrally controlled fluid communication intermediate a fluid-supply source and the control-cylinder units.

18. A controlled-pneumatic marine-riser tensioner as described in claim 17 and further comprising:

separate accumulators in fluid communication intermediate the separately controlled pumps and valve units.

19. A controlled-pneumatic marine-riser tensioner as described in claim 1 wherein:

the separately controllable means of supply of pressurized control fluid to the pressurized portions of the control cylinders has a liquid pump in fluid communication from a fluid supply source to the fluid-pressure tubes.

20. A controlled-pneumatic marine-riser tensioner as described in claim 1 wherein:

the separately controllable means of supply of pressurized control fluid to the pressurized portions of the control cylinders has an air compressor in fluid communication with the fluid-pressure tubes.

21. A controlled-pneumatic marine-riser tensioner as described in claim 1 wherein:

the separately controllable means of supply of pressurized control fluid to the pressurized portions of the control cylinders has an air compressor in fluid communication with a pressure converter in which compressed air is directed against liquid that is directed to the fluid-pressure tubes.

22. A controlled-pneumatic marine-riser tensioner as described in claim 21 and further comprising:

a plurality of backup-pressure vessels into which compressed air from the air compressor is directed for central storage of high volumes of compressed air for rapid availability for pressurizing a plurality of control-cylinder units;

a plurality of air-pressure groups of group pressure vessels into which compressed air from the air compressor and/or the backup-pressure vessels is directed;

a plurality of accumulator banks of pressure-conversion vessels in which compressed air from group pressure vessels is directed against liquid that is conveyed separately to the plurality of control-cylinder units; and a plurality of liquid conveyances in fluid communication from the pressure-conversion vessels to the pressurized portions of the control cylinders.

23. A controlled-pneumatic marine-riser tensioner as described in claim 22 and further comprising:

a plurality of large valves in the plurality of liquid conveyances; and the plurality of large valves having selective flow-control through the liquid conveyances.

24. A controlled-pneumatic marine-riser tensioner as described in claim 23 and further comprising:

a plurality of small valves in the plurality of liquid conveyances; and the plurality of small valves having optionally selective flow-control through the liquid conveyances.

25. A controlled-pneumatic marine-riser tensioner as described in claim 24 and further comprising:

a plurality of return gas lines in fluid communication from low-pressure ends of the control-cylinder units to a plurality of tensioner valve panels.

26. A method comprising the following steps for tensioning a marine riser:

providing a plurality of control-cylinder units having separately controllable tensioning force in an upwardly tensioning direction;

pivotally attaching top ends the control-cylinder units to a marine vessel about a bottom portion of a drill-stem-insertion portion of an operational floor of the marine vessel;

pivotally attaching bottom ends of the control-cylinder units to a riser-tensioner ring vertically beneath the operational floor;

attaching a seabed-anchored marine riser to the riser-tensioner ring;

supplying control fluid to the control-cylinder units separately at rates of supply and at levels of pressure to provide pressurized control fluid to variable cylinder volumes of separate control-cylinder units at pressures and volumes to achieve select vertically upward pressures of control cylinders in controlled reaction to wave-generated positioning, weather-generated positioning and otherwise caused positioning of the marine vessel in relationship to a length of tensioned marine riser having a proximal end that is attached to the riser-tensioner ring and a distal end that is affixed to a seabed.

27. A method as described in claim 26 wherein:

supplying control fluid to the control-cylinder units separately is provided with separate supply sources having separate control units in closed-loop controllable communication with the control-cylinder units.

28. A method as described in claim 26 wherein:

the control fluid supplied to the control-cylinder units is liquid that is pumped by a liquid pump.

29. A method as described in claim 26 wherein:

the control fluid supplied to the control-cylinder units is air that is pumped by an air compressor.

30. A method as described in claim 26 wherein:

the control fluid supplied to the control-cylinder units is liquid that is pressured by compressed air that is pumped by an air compressor.

* * * * *